US009016832B2

(12) United States Patent
Shinoda

(10) Patent No.: US 9,016,832 B2
(45) Date of Patent: Apr. 28, 2015

(54) LIQUID EJECTING APPARATUS

(71) Applicant: Akira Shinoda, Obu (JP)

(72) Inventor: Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/016,043

(22) Filed: Aug. 30, 2013

(65) Prior Publication Data

US 2014/0009530 A1 Jan. 9, 2014

Related U.S. Application Data

(63) Continuation of application No. 13/030,131, filed on Feb. 18, 2011, now Pat. No. 8,636,337.

(30) Foreign Application Priority Data

Mar. 30, 2010 (JP) ..... 2010-077747

(51) Int. Cl.
*B41J 2/165* (2006.01)

(52) U.S. Cl.
CPC .... *B41J 2/16505* (2013.01); *B41J 2002/16502* (2013.01)

(58) Field of Classification Search
CPC ..... B41J 2/16505; B41J 2/165; B41J 2002/16555; B41J 2/16511; B41J 29/13; B41J 2/175; B41J 2/17536
USPC ..... 347/22, 23, 29, 32–34, 40
See application file for complete search history.

(56) References Cited

U.S. PATENT DOCUMENTS 6,151,043 A 11/2000 Michael et al.
6,203,136 B1 3/2001 Takahashi et al.
6,290,323 B1 9/2001 Sharma et al.
(Continued)

FOREIGN PATENT DOCUMENTS

EP 2371549 A1 10/2011
GB 2280149 A 1/1995
(Continued)

OTHER PUBLICATIONS

European Patent Office, European Search Report for European Patent Application No. 11000955.2 (counterpart to co-pending U.S. Appl. No. 13/030,131), dated Aug. 11, 2011.
(Continued)

*Primary Examiner* — Thinh Nguyen
(74) *Attorney, Agent, or Firm* — Baker Botts L.L.P.

(57) ABSTRACT

A liquid ejecting apparatus, including: a head having an ejection surface; a head holder; a capping mechanism for capping the ejection surface, having: a facing member with a facing surface to face the ejection surface; and a protrusion provided on the head holder for isolating, from an external space, an ejection space formed between the ejection surface and the facing surface when a tip of the protrusion contacts the facing surface; and a humidifying mechanism having: a circulation passage whose first and second ends are open to the ejection space through openings thereof provided in one of the head and the head holder; and a humidifier for humidifying an air in the passage, the humidifying mechanism being configured to collect an air in the ejection space from the opening of the first end and to supply an air humidified by the humidifier into the ejection space from the opening of the second end.

8 Claims, 10 Drawing Sheets

(56) References Cited

U.S. PATENT DOCUMENTS

| | | | | |
|---|---|---|---|---|
| 6,312,092 | B1 | 11/2001 | Usui et al. | |
| 7,806,517 | B2 * | 10/2010 | Muraoka | 347/65 |
| 8,272,708 | B2 | 9/2012 | Silverbrook et al. | |
| 2007/0206047 | A1 | 9/2007 | Matsuda | |
| 2007/0229581 | A1 | 10/2007 | Taira et al. | |
| 2007/0229611 | A1 | 10/2007 | Nagashima | |
| 2007/0257957 | A1 | 11/2007 | Takagi | |
| 2008/0284814 | A1 | 11/2008 | Chikamoto et al. | |
| 2011/0242204 | A1 | 10/2011 | Shinoda | |
| 2012/0206537 | A1 | 8/2012 | Nukui et al. | |

FOREIGN PATENT DOCUMENTS

| | | | |
|---|---|---|---|
| JP | S64-005852 | A | 1/1989 |
| JP | H02-192951 | A | 7/1990 |
| JP | H03-184852 | A | 8/1991 |
| JP | H09-085959 | A | 3/1997 |
| JP | H10-264402 | A | 10/1998 |
| JP | 2000-079696 | A | 3/2000 |
| JP | 2002-127440 | A | 5/2002 |
| JP | 2003-165230 | A | 6/2003 |
| JP | 2005-212138 | A | 8/2005 |
| JP | 2005-271314 | A | 10/2005 |
| JP | 2007-230137 | A | 9/2007 |
| JP | 2008-030357 | A | 2/2008 |
| JP | 2011-207091 | A | 10/2011 |
| JP | 2012-166368 | A | 9/2012 |

OTHER PUBLICATIONS

Japan Patent Office, Notification of Reason(s) for Refusal for Japanese Patent Application No. 2007-077747 (counterpart to co-pending U.S. Appl. No. 13/030,131), dispatched Jul. 24, 2012.

Japan Patent Office, Decision of Refusal for Japanese Patent Application No. 2007-077747 (counterpart to co-pending U.S. Appl. No. 13/030,131), dispatched Oct. 16, 2012.

The State Intellectual Property Office of the People's Republic of China, Notification of First Office Action for Chinese Patent Application No. 201110048527.8 (counterpart to co-pending U.S. Appl. No. 13/030,131), issued Apr. 3, 2013.

United States Patent and Trademark Office, Non-Final Office Action for U.S. Appl. No. 13/356,531 (related to co-pending U.S. Appl. No. 13/030,131), mailed Apr. 5, 2013.

United States Patent and Trademark Office, Final Office Action for U.S. Appl. No. 13/356,531 (related to co-pending U.S. Appl. No. 13/030,131), mailed Jul. 17, 2013.

European Patent Office, European Search Report for European Patent Application No. 12151356.8 (counterpart to co-pending U.S. Appl. No. 13/030,131), dated May 18, 2012.

United States Patent and Trademark Office, Non Final Office Action for U.S. Appl. No. 13/851,022 (related to above-captioned patent application), mailed Jul. 18, 2014.

United States Patent and Trademark Office, Non Final Office Action for U.S. Appl. No. 13/356,531 (related to above-captioned patent application), mailed Aug. 18, 2014.

* cited by examiner

LIQUID EJECTING APPARATUS

CROSS REFERENCE TO RELATED APPLICATION

The present application is a continuation of U.S. patent application Ser. No. 13/030,131, which was filed on Feb. 18, 2011, which claims priority from Japanese Patent Application No. 2010-077747, which was filed on Mar. 30, 2010, the disclosures of which are herein incorporated by reference in their entirety.

BACKGROUND OF THE INVENTION

1. Field of the Invention

The present invention relates to a liquid ejecting apparatus configured to eject a liquid such as ink.

2. Discussion of Related Art

An ink-jet printer as one example of a liquid ejecting apparatus includes a head having an ejection surface in which a multiplicity of ejection openings are open for ejecting ink therethrough. When a situation in which the ink is not ejected from the ejection openings continues for a long period of time, the viscosity of the ink increases in the vicinity of the ejection openings due to evaporation, thereby causing clogging of the ejection openings. To prevent the clogging of the ejection openings, there is known a technique in which the ejection surface is covered by a cap (capping portion) and an operation for humidifying an air in the cap by an air conditioning device (humidification maintenance) is performed.

SUMMARY OF THE INVENTION

The above-indicated technique, however, suffers from the following problems. Since a humidifying mechanism needs to be provided in the cap, the cap tends to become large-sized and accordingly the printer tends to become large-sized. Further, when the humidification maintenance is performed, the cap needs to come into contact with the ejection surface of the head at a predetermined position so as to surround a group of the ejection openings, requiring a high degree of accuracy for positioning the head and the cap relative to each other. Accordingly, it undesirably takes a long time to position the head and the cap relative to each other, hindering prompt initiation of the humidification maintenance.

It is therefore an object of the invention to provide a liquid ejecting apparatus which realizes reduction in both of a time relating to initiation of a humidification maintenance and a size of the apparatus.

The above-indicated object may be attained according to a principle of the invention, which provides a liquid ejecting apparatus, comprising:

a head having an ejection surface in which ejection openings are open through which a liquid is ejected to a recording medium;

a head holder for holding the head;

a capping mechanism which is configured to cap the ejection surface and which has: a facing member having a facing surface to face the ejection surface; and a protrusion provided on the head holder and having a tip, the protrusion being configured such that the protrusion isolates, from an external space, an ejection space formed between the ejection surface and the facing surface when the tip contacts the facing surface; and a humidifying mechanism which has a circulation passage having, at opposite ends thereof, a first end and a second end that are open to the ejection space; and a humidifier configured to humidify an air in the circulation passage, an opening of the first end and an opening of the second end being provided in one of the head and the head holder, the humidifying mechanism being configured to collect an air in the ejection space from the opening of the first end and to supply an air humidified by the humidifier into the ejection space from the opening of the second end.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be hereinafter described preferred embodiments of the invention with reference to the drawings.

Figure 1:
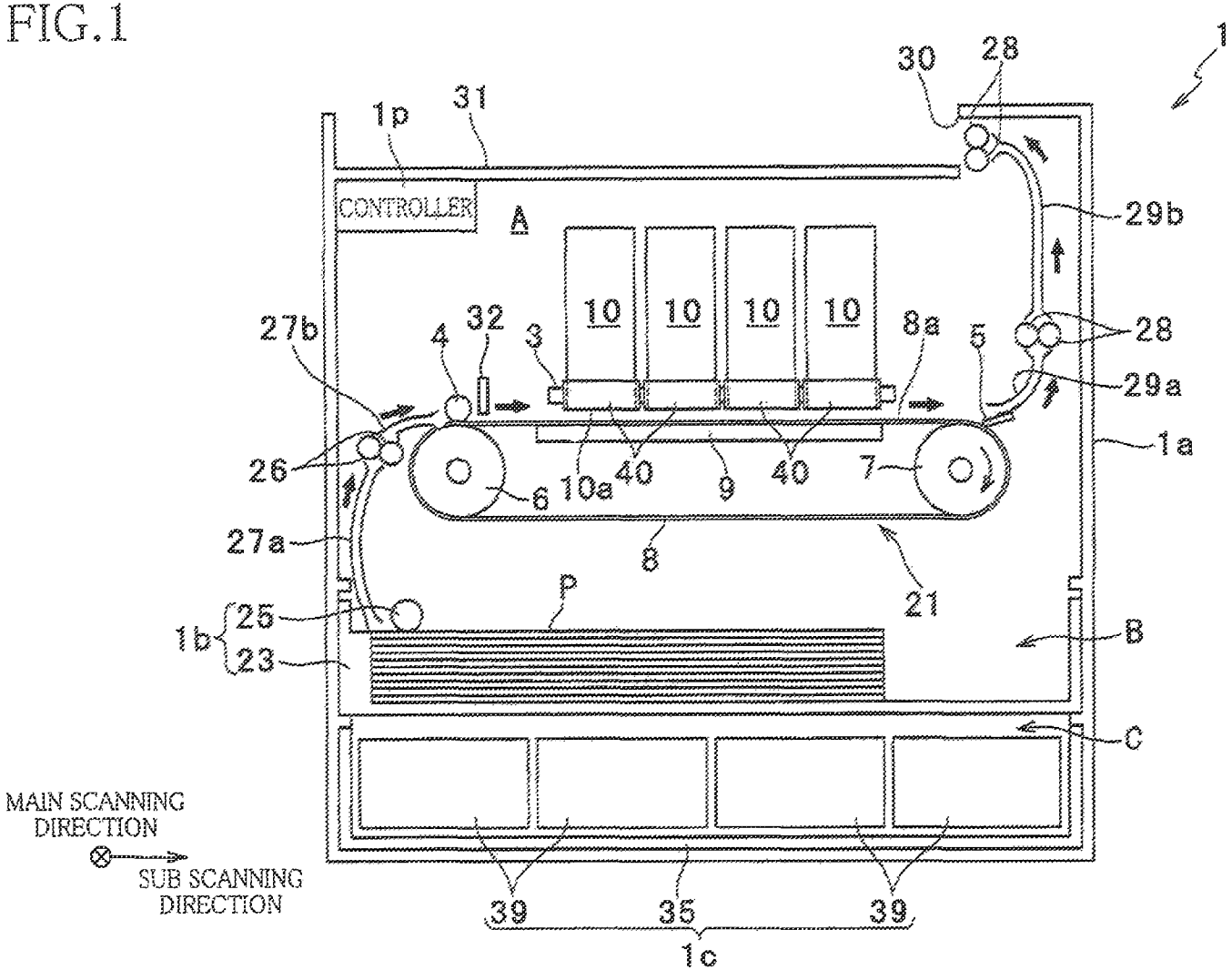
FIG. 1 is a side view in cross section schematically showing an internal structure of an inkjet printer according to a first embodiment of the invention.

Referring first to FIG. 1, there will be explained an overall structure of an inkjet printer 1, as a liquid ejecting apparatus, constructed according to a first embodiment of the invention.

As shown in FIG. 1, the inkjet printer 1 has a casing 1*a* having a rectangular parallelepiped shape. A discharged-sheet receiving portion 31 is provided on a top plate of the casing 1*a*. An inner space of the casing 1*a*. is divided into three spaces A, B, and C which are arranged in this order in a direction from the top to the bottom of the casing 1*a*. In the spaces A and B, there is formed a sheet traveling route connecting to the discharged-sheet receiving portion 31. In the space C, there are accommodated ink cartridges 39 as an ink supply source from which respective inks are supplied to respective inkjet heads 10.

In the space A, there are disposed the four heads 10, a conveyor unit 21 for conveying a sheet P as a recording medium, a guide unit for guiding the sheet F, a humidifying mechanism 50 (FIG. 5) used in humidification maintenance described below, and so on. A controller 1*p* is disposed in an upper portion of the space A. The controller 1*p* is configured to control operations of various parts of the printer 1 so as to control the printer 1 as a whole.

The controller 1*p* controls, on the basis of image data supplied from an external device, a conveyance operation of the sheet P, an ink ejecting operation synchronized with the conveyance of the sheet P, a maintenance operation relating to recovery and maintenance of ejection performance, and so on, which are performed by various parts of the printer 1. The maintenance operation includes flushing, purging, wiping, and the humidification maintenance. The flushing is an operation in which ink is forcibly ejected from all ejection openings 14*a* by activating all actuators of the heads 10 on the basis of flushing data different from the image data. The purging is an operation in which ink is forcibly ejected from all ejection openings 14*a* by giving a pressure to the ink in the heads 10 by a pimp or the like. The wiping is an operation in which ejection surfaces 10*a* of the heads 10 are wiped by a wiper after the flushing or the purging so as to remove foreign substances from the ejection surfaces 10*a*. The humidification maintenance is an operation in which a humidified air is supplied into an ejection space S1 (FIG. 5) partially defined by an enclosing member 40. The humidification maintenance will be later explained in detail.

The conveyor unit 21 as a medium support portion includes belt rollers 6, 7, an endless conveyor belt 8 wound around the two belt rollers 6, 7, a nip roller 4 and a separation plate 5 disposed outside the conveyor belt 8, and a platen 9 disposed inside the conveyor belt 8. The belt roller 7 is a drive roller configured to rotate clockwise in FIG. 1 by driving of a conveyance motor (not shown). In accordance with the rotation of the belt roller 7, the conveyor belt 8 moves or runs in a direction indicated by bold arrows in FIG. 1. The belt roller 6 is a driven roller configured to rotate clockwise in. FIG. 1 by the movement of the conveyor belt 8. The nip roller 4 is disposed so as to be opposed to the belt roller 6 with the conveyor belt 8 interposed therebetween. The sheet P supplied from an upstream side of a sheet conveyance direction in which the sheet P is conveyed is pressed by the nip roller 4 onto a sheet support surface 8*a* which is an outer surface of the conveyor belt 8. The sheet P is subsequently conveyed toward the belt roller 7 in accordance with the movement of the conveyor belt 8 while being supported on the sheet support surface 8*a*. Thus, the sheet support surface 8*a* functions as a medium support surface. The separation plate 5 is disposed so as to be opposed to the belt roller 7 and is configured to separate the sheet P from the sheet support surface 8*a* and guide the sheet P to a downstream side in the sheet conveyance direction. The platen 9 is disposed so as to be opposed to the four heads 10 and supports an upper portion of the loop of the conveyor belt 8 from inside the loop.

Each of the four ink-jet heads 10 is a line head having a generally rectangular parallelepiped shape that is long in a main scanning direction. The lower surface of each head 10 is formed as the ejection surface 10*a* in which a multiplicity of the ejection openings 14*a* (FIGS. 3 end 4) are open. In a recording or image forming operation, a magenta ink, a cyan ink, a yellow ink, and a black ink are ejected from the ejection surfaces 10*a* of the respective four heads 10. The four heads 10 are arranged in a sub scanning direction perpendicular to the main scanning direction at a suitable pitch and are supported by the casing 1*a* via a head holder 3. The head holder 3 holds the heads 10 such that the ejection surfaces 10*a* are opposed to the sheet support surface 8*a* at the upper portion of the loop of the conveyor belt 8 and such that a clearance suitable for the recording operation is formed between the ejection surfaces 10*a* and the sheet support surface 8*a*. Thus, the conveyor belt 8 serves as a facing member having the sheet support surface 8*a* as a facing surface that faces the ejection surfaces 10*a*. On the head holder 3, there are provided enclosing members 40 for the respective four heads 10 such that each enclosing member 40 surrounds the corresponding head 10, specifically, the outer periphery of the ejection surface 10*a* of the corresponding head 10. The structure of each head 10 and the structure of the head holder 3 will be explained in detail.

The guide unit includes an upstream guide portion and a downstream guide portion disposed so as to sandwich the conveyor unit 21 therebetween. The upstream guide portion includes two guides 27*a*, 27*b* and a pair of feed rollers 26. The upstream guide portion connects a sheet supply unit 1*b* that will be explained and the conveyor unit 21. The downstream guide portion includes two guides 29*a*, 29*b* and two pairs of feed rollers 28. The downstream guide portion connects the conveyor unit 21 and the discharged-sheet receiving portion 31.

In the space B, the sheet supply unit 1*b* is disposed so as to be attachable to and detachable from the casing 1*a*. The sheet supply unit 1*b* includes a sheet tray 23 and a sheet supply roller 25. The sheet tray 23 is a box-like member opening upward and is capable of accommodating sheets P with a plurality of kinds of size. The sheet supply roller 25 is configured to pick up an uppermost one of the sheets P in the sheet tray 23 and supply the sheet P to the upstream guide portion.

As described above, the sheet traveling route is formed in the spaces A and B so as to extend from the sheet supply unit 1*b* to the discharged-sheet receiving portion 31 via the conveyor unit 21. The controller 1*p* drives a sheet supply motor (not shown) for the sheet supply roller 25, a feed motor (not shown) for the feed rollers of each guide portion, the conveyance motor, etc., on the basis of record commands received from the external device. The sheet P supplied from the sheet tray 23 is fed to the conveyor unit 21 by the feed rollers 26. When the sheet P passes immediately below the heads 10 in the sub scanning direction, the inks are ejected from the respective ejection surfaces 10*a*, so that a color image is formed on the sheet P. The ink ejecting operation is carried out on the basis of a detection signal from a sheet sensor 32. Thereafter, the sheet P is separated from the sheet support surface 8*a* of the conveyor belt 8 by the separation plate 5 and fed upward by the two feed rollers 28. The sheet P is finally discharged onto the discharged-sheet receiving portion 31 through an upper opening 30 of the casing 1*a*.

Here, the sub scanning direction is a direction parallel to the direction of conveyance of the sheet P by the conveyor unit 21 and the main scanning direction is a direction parallel to the horizontal plane and perpendicular to the sub scanning direction.

In the space C, an ink unit 1*c* is disposed so as to be attachable to and detachable from the casing 1*a*. The ink unit 1*c* includes a cartridge tray 35 and four ink cartridges 39 accommodated in the tray 35. The inks in the respective cartridges 39 are supplied to the corresponding heads 10 through respective ink tubes (not shown).

Figure 2:
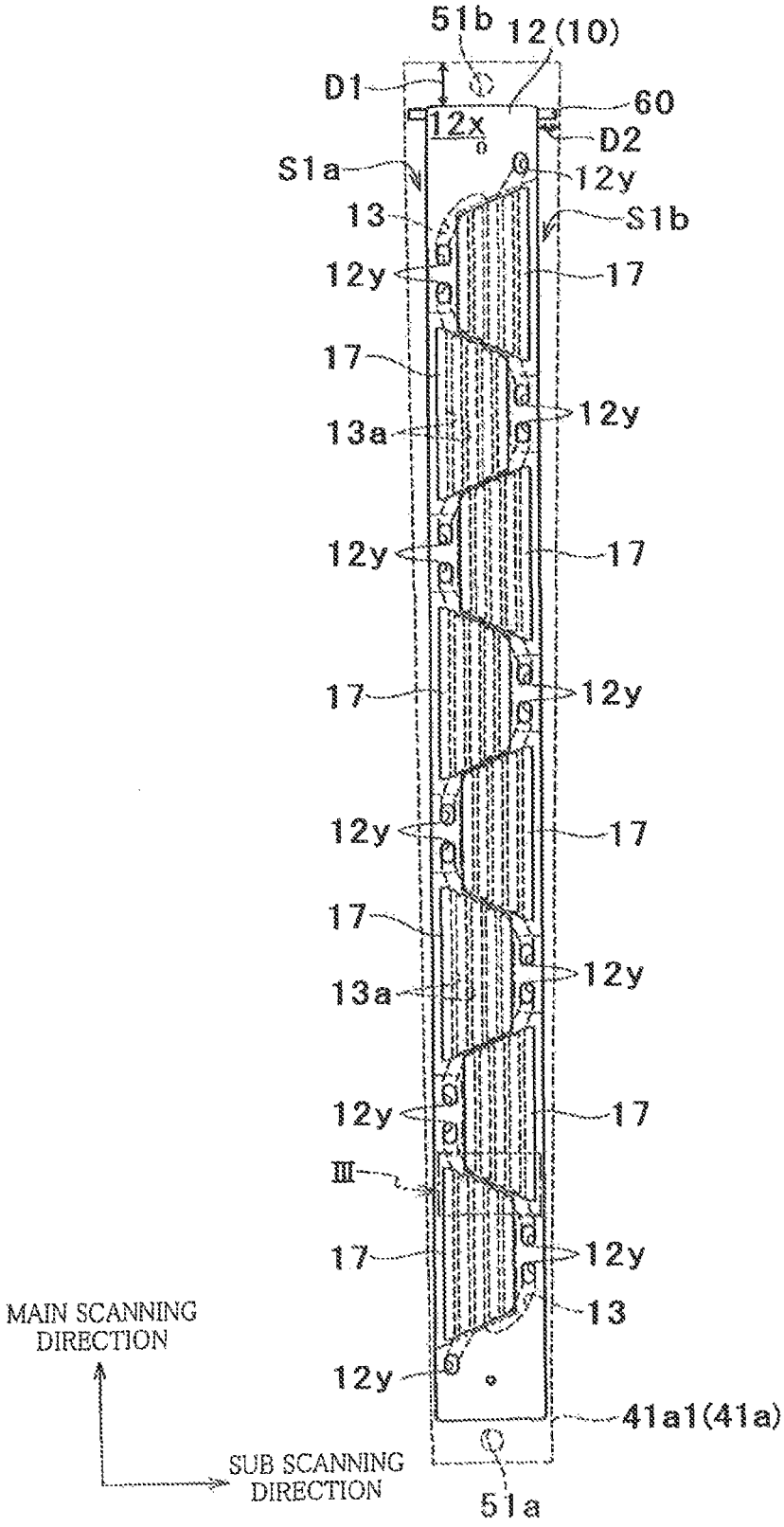
FIG. 2 is a plan view of a flow-passage unit and actuator units included in the printer of FIG. 1.
Figure 3:
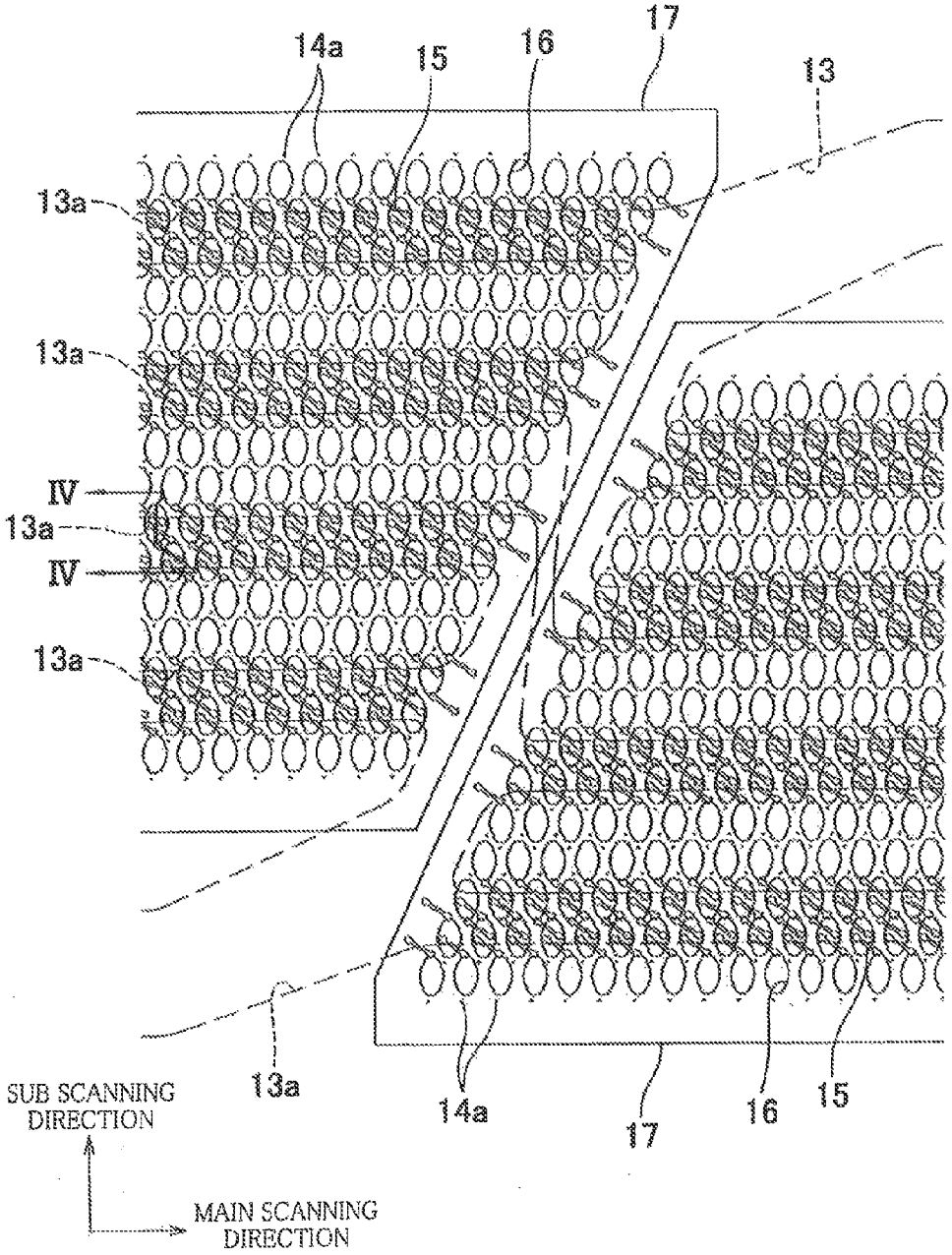
FIG. 3 is an enlarged view showing a region III enclosed by a dot-dash line in FIG. 2.

Referring next to FIGS. 2-4 and 7, the structure of the head 10 will be explained. In FIG. 3, pressure chambers 16 and apertures 15 which are located under actuator units 17 and should be indicated by a dotted line are indicated by a solid fine.

Each head 10 includes a reservoir unit 11 and a flow-passage unit 12 that are superposed on each other (FIG. 6), eight actuator units 17 (FIG. 2) fixed to an upper surface 12*x* of the flow-passage unit 12, and a flat flexible printed circuit (FPC) 19 (FIG. 4) bonded to each actuator unit 17. In the reservoir unit 11, there are formed ink passages that include a reservoir in which the ink supplied from the corresponding cartridge 39 is temporarily stored. In the flow-passage unit 12, there are formed ink passages extending from the corresponding opening 12*y* (FIG. 2) formed in the upper surface 12*x* and reaching the corresponding ejection openings 14*a* formed in the lower surface (ejection surface 10*a*). Each actuator unit 17 includes piezoelectric actuators for the respective ejection openings 14*a*.

The lower surface of the reservoir unit 11 has projecting portions and recessed portions. The projecting portions are bonded to respective regions of the upper surface 12*x* of the flow-passage unit 12 at which the actuator units 17 are not disposed, namely, respective regions including the respective openings 12*y* and enclosed by a two-dot chain line in FIG. 2. On the top of each projecting portion, there are formed openings which are connected to the reservoir and which face the corresponding openings 12*y* of the flow-passage unit 12. According to the arrangement, the reservoir and individual ink channels 14 are held in communication with each other through the openings. The recessed portions are opposed to the upper surface 12*x* of the flow-passage unit 12, the surfaces of the actuator units 17, and the surface of the FPC 19 with a slight clearance therebetween.

Figure 4:
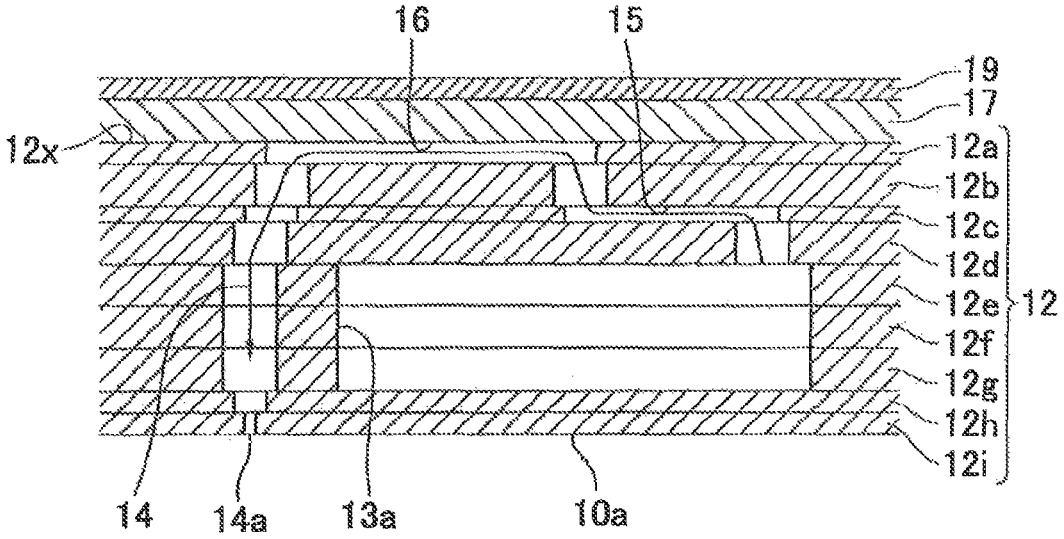
FIG. 4 is a partial cross-sectional view taken along line IV-IV in FIG. 3.

The flow-passage unit 12 is a laminated body composed of nine rectangular metal plates 12*a*, 12*b*, 12*c*, 12*d*, 12*e*, 12*f*, 12*g*, 12*h*, 12*i* (FIG. 4) which are superposed on and bonded to one another and which have substantially the same size. As shown in FIGS. 2-4, each ink passage of the flow-passage unit 12 includes a manifold 13 having at one end thereof the opening 12*y*, sub manifolds 13*a* branched from the manifold 13, and the individual ink channels 14 each extending from an outlet of the corresponding sub manifold 13*a* to the corresponding ejection opening 14*a* via the corresponding pressure chamber 16. As shown in FIG. 4, the individual ink channels 14 are formed for the respective ejection openings 14*a* and include the respective apertures 15 each functioning as an orifice for adjusting a resistance to the ink flow. In regions of the upper surface 12*x* to which the actuator units 17 are respectively bonded (hereinafter referred to as "bonded regions" where appropriate), there are formed, in matrix, openings having a generally rhombic shape and defining the respective pressure chambers 16. In regions of the lower surface (the ejection surface 10*a*) which respectively correspond to the above-indicated bonded regions of the upper surface 12*x*, the ejection openings 14*a* are formed, in matrix, in the same pattern as the pressure chambers 16.

As shown in FIG. 2, the actuator units 17 each having a trapezoidal shape in plan view are disposed on the upper surface 12*x* of the flow-passage unit 12 in two rows such that the actuator units 17 of the two rows are arranged in a zigzag fashion. As shown in FIG. 3, each of the actuator units 17 entirely covers the openings of a group of the pressure chambers 16 formed within a corresponding one of the bonded regions of the upper surface 12*x* to which the actuator units 17 are respectively bonded. While not shown, each actuator unit 17 includes a plurality of piezoelectric layers extending over the group of the pressure chambers 16 and electrodes which sandwich each piezoelectric layer in the thickness direction. The electrodes include individual electrodes 16 provided for the respective pressure chambers 16 and a common electrode that is common to the group of the pressure chambers 16. The individual electrodes are formed on an uppermost one of the plurality of piezoelectric layers.

The FPC 19 includes wires that correspond to the respective electrodes of each actuator unit 17, and a driver IC not shown) is mounted on the FPC 19 so as to be connected to the wires. The FPC 19 is fixed at one end thereof to the actuator units 17 and at another end thereof to a control board (not shown) of the head 10 disposed above the reservoir unit 11. Under the control of the controller 1*p*, the FPC 19 transmits drive signals outputted from the control board to the driver IC and transmits signals generated by the driver IC to the actuator units 17.

Figure 5:
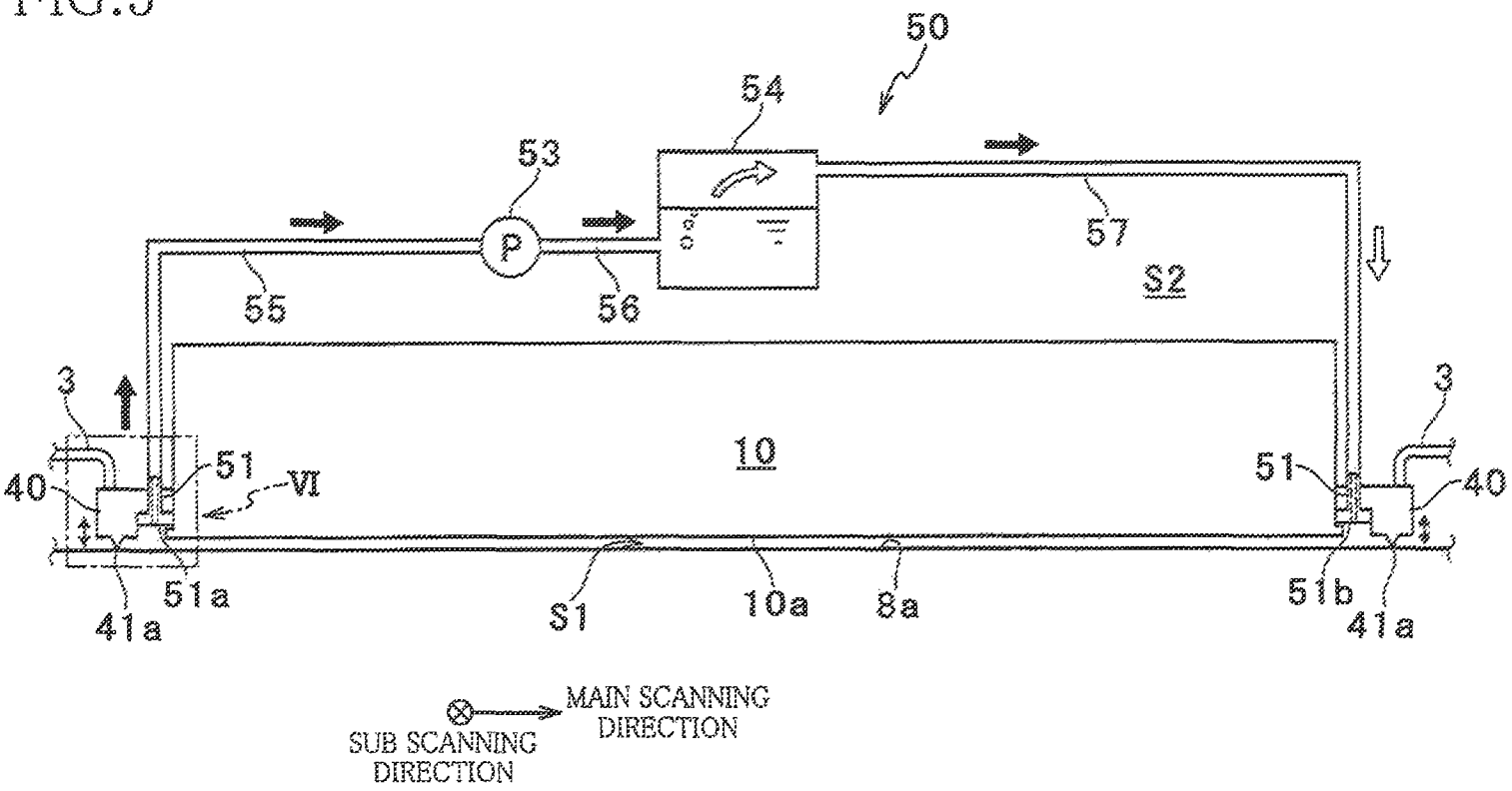
FIG. 5 is a schematic view showing a head holder and a humidifying mechanism included in the printer of FIG. 1.
Figure 6:
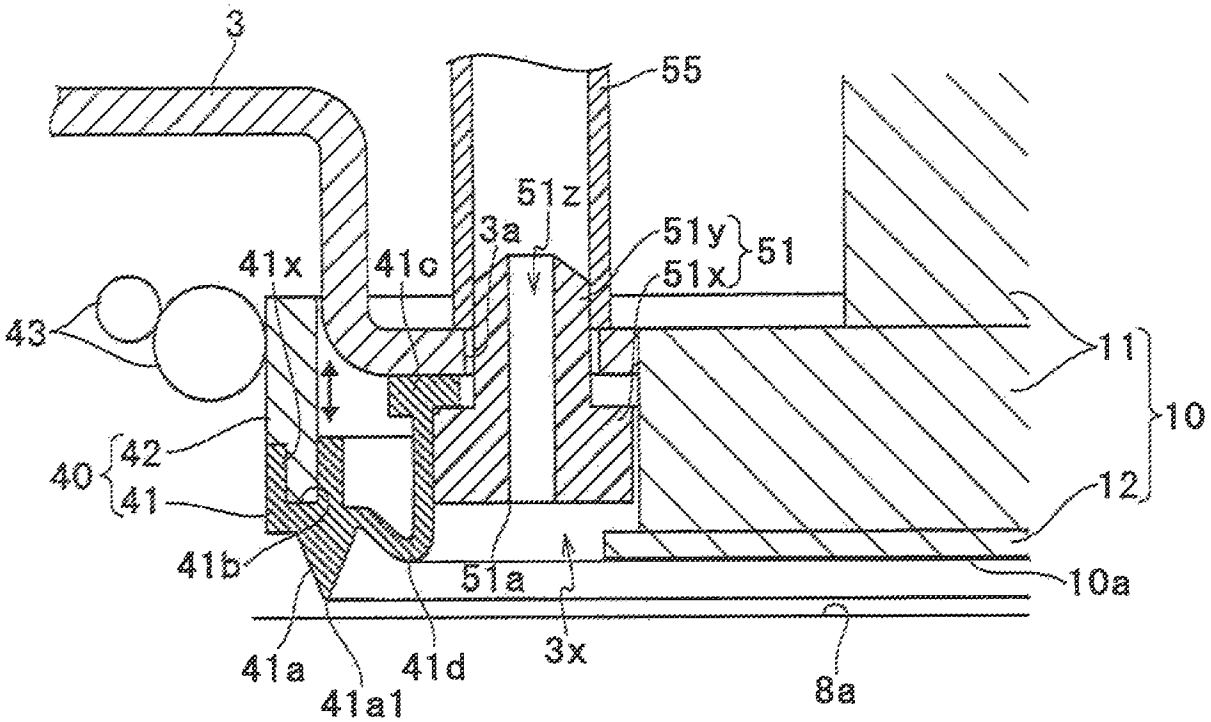
FIG. 6 is a partial cross-sectional view showing a region VI enclosed by a dot-dash line in FIG. 5.

Referring next to FIGS. 2, 5, and 6, the structure of the head holder 3 will be explained.

The head holder 3 is a metal frame. To the head holder 3, there are attached four enclosing members 40 and four pairs of joints 51. One enclosing member 40 and one pair of joints 51 are provided for one head 10.

As shown in FIG. 5, one pair of the joints 51 constitute opposite ends, i.e., a first end and a second end, of a circulation passage in a humidifying mechanism 50. The joints 51 are disposed so as to be located adjacent to respective longitudinally opposite ends of the corresponding head 10. In the humidification maintenance, an air is collected from an opening 51*a* at the lower surface of one of the pair of joints 51, namely, the left-side joint 51 in FIG. 5, and a humidified air is supplied from an opening 51*b* at the lower surface of the other of the pair of joints 51, namely, the right-side joint 51 in FIG. 5. Hereinafter, the left-side joint 51 (FIG. 5) relating to air collection is referred to as "the first joint" and the right-side joint 51 (FIG. 5) relating to humidified-air supply is referred to as "the second joint" where the two joints 51 need to be distinguished from each other.

As shown in FIG. 6, the joint 51 is generally cylindrical and includes a base portion 51*x* and an extending portion 51*y* that extends from the base portion 51*x*. A hollow space 51*z* having a cylindrical columnar shape is formed through the base portion 51*x* and the extending portion 51*y* so as to extend in the vertical direction. The base portion 51*x* and the extending portion 51*y* have mutually different outside diameters, namely, the outside diameter of the base portion 51*x* is larger than that of the extending portion 51*y*. The hollow space 51*z* has a constant diameter in the vertical direction. The extending portion 51*y* has, at its upper end, a cut portion formed around the entire outer circumference thereof, so as to have a tapered shape, thereby facilitating connection of tubes 55, 57 to the extending portions 51*y* of the respective joints 51.

Each of the joints 51 is fixed to the head holder 3 such that the extending portion 51*y* is inserted into a through-hole 3*a* of the head holder 3. The through-holes 3*a* are formed so as to correspond to the positions of the respective joints 51, namely, so as to be adjacent to one and the other of the longitudinally opposite ends of the corresponding head 10. The outside diameter of the extending portion 51*y* of the joint 51 is somewhat smaller than the diameter of the through-hole 3*a*, so that there exists a slight spacing between the outer circumferential surface of the extending portion 51*y* and the wall of the head holder 3 that defines the through-hole 3*a*. This spacing is closed by being filled with a sealer or the like when the joint 51 is fixed to the head holder 3.

The enclosing member 40 is formed so as to surround the periphery of the ejection surface 10*a* of the corresponding head 10 in plan view, in other words, as seen from the direction orthogonal to the ejection surface 10*a*, and includes: an elastic body 41 which is supported, through its fixed portion 41*c*, on the head holder 3; and a movable body 42 which is movable up and down. The enclosing member 40 may be referred to as a cap, a skirt, or a sleeve.

The elastic body 41 is made of an elastic material such as rubber and includes a base portion 41*x*, a protrusion 41*a* which protrudes downward from the lower surface of the base portion 41*x* and which has an inverted triangular shape in cross section, the fixed portion 41*c* which is fixed to the head holder 3 and which has a "T" shape in cross section, and a connecting portion 41D which connects the base portion 41*x* and the fixed portion 41*c*. The elastic body 41 having the above-indicated portions is formed so as to surround the periphery of the ejection surface 10*a* of the head 10 in plan view. The fixed portion 41*c* is fixed to the head holder 3 at its upper end with an adhesive or the like interposed therebetween, and is held by and between the head holder 3 and the base portion 51*x* of the joint 51 in the vicinity of the through-hole 3*a*. The connecting portion 41*d* extends from the lower end of the fixed portion 41*c* outwardly, i.e., in a direction away from the ejection surface 10*a* in plan view, in a curved manner, and is connected to the lower end of the base portion 41*x*. The connecting portion 41*d* has flexibility that permits deformation thereof in accordance with the up-down movement of the movable body 42. There is formed, in the upper surface of the base portion 41*x*, a recess 41*b* in which the lower end of the movable body 42 is fitted.

The movable body 42 is made of a rigid or stiff material and is formed so as to surround the periphery of the ejection surface 10*a* of the head 10 in plan view, like the elastic body 41. The movable body 42 is configured to be movable in the vertical direction relative to the head holder 3 while being supported by the head holder 3 through the elastic body 41. More specifically, the movable body 42 is connected to a plurality of gears 43 and is configured to be movable up and down in accordance with rotation of the gears 43 by a motor being driven under the control of the controller 1*p*. When the movable body 42 is moved up and down, the base portion 41*x* is also moved up and down together with the movable member 42 since the lower end of the movable body 42 is fitted in the recess 41*b* of the elastic body 41. That is, when the movable body 42 is moved up and down, the elastic body 41 is moved such that the base portion 41*x* including the protrusion 41*a* is moved up and down together with the movable body 42 while the fixed portion 41*c* is fixed to the head holder 3. Accordingly, a relative position of a tip 41*a*1 of the protrusion 41*a* with respect to the ejection surface 10*a*. in the vertical direction changes.

By the up-down movement of the movable body 42, the protrusion 41*a* of the elastic body 41 is selectively placed at one of a contact position (shown in FIG. 5) at which the tip 41*a*1 of the protrusion 41*a* contacts the sheet support surface 8*a* of the conveyor belt 8 and a retracted position (shown in FIG. 6) at which the tip 41*a*1 is separated away from the sheet support surface 8*a*. As shown in FIG. 5, when the protrusion 41*a* is located at the contact position, an ejection space S1 formed between the ejection surface 10*a* and the sheet support surface 8*a* is isolated from an exterior space S2. As shown in FIG. 6, when the protrusion 41*a* is located at the retracted position, the tip 41*a*1 of the protrusion 41*a* is located between the ejection surface 10*a* and the sheet support surface 8*a*, namely, the tip 41*a*1 is located nearer to the sheet support surface 8*a*, as compared with the ejection surface 10*a*. That is when the protrusion 41*a* is located at the retracted position, a distance by which the tip 41*a*1 is distant from the sheet support surface 8*a* is smaller than a distance by which the ejection surface 10*a* is distant from the sheet support surface 8*a*.

The protrusion 41*a* is separated away from the ejection surface 10*a* (the lower surface of the head 10 shown in FIG. 2) over the entire periphery of the ejection surface 10*a*, in plan view, namely, as seen from the direction orthogonal to the ejection surface 10*a*. Further, the protrusion 41*a* surrounds the periphery of the ejection surface 101 so as to form a trapezoidal shape, in plan view, having its upper base which is located in the vicinity of the one of the longitudinally opposite end portions of the head 10 (i.e., the lower end of the head 10 as seen in FIG. 2) and its lower base which is located in the vicinity of the other of the longitudinally opposite end portions of the head 10 (i.e., the upper end of the head 10 as seen in FIG. 2). In other words, the contour of the protrusion 41*a* in plan view is a trapezoidal shape.

Here, the positional relationship between the protrusion 41*a* and the ejection surface 10*a*, i.e., the lower surface of the head 10 shown in FIG. 2, is considered in terms of a distance, in plan view, namely, a distance as seen from a direction orthogonal to the ejection surface 10*a* (as seen from the bottom of the head 10), by which the ejection surface 10*a* and the tip 41*a*1 of the protrusion 41*a* are spaced apart from each other. The distance may be hereinafter referred to as "separation distance" where appropriate. More specifically, a separation distance D2 by which the ejection surface 10*a* and the tip 41*a*1 of the protrusion 41*a* are spaced apart from each other in the sub scanning direction is smaller than a separation distance D1 by which the ejection surface 10*a* and the tip 41*a*1 of the protrusion 41*a* are spaced apart from each other in the main scanning direction across the opening 51*b*. The above-indicated, separation distance D1 in the main scanning direction is the same at opposite ends of the ejection surface 10*a* in the main scanning direction and is constant along the sub scanning direction. On the other hand, the above-indicated separation distance D2 in the sub scanning direction is the same at opposite ends of the ejection surface 10*a* in the sub scanning direction, but is not constant along the main scanning direction. That is, the above-indicated separation distance D2 in the sub scanning direction gradually decreases from the opening 51*b* toward the opening 51*a* along the main scanning direction.

A pair of regulating plates 60 as a regulator are provided at the other of the longitudinally opposite end portions of the head 10 the upper end portion of the head 10 in FIG. 2). The regulating plates 60 are fixed to respective side surfaces of the flow-passage unit 12 at the other of the longitudinally opposite end portions and extend along the sub scanning direction from the respective side surfaces near to the tip 41*a*1 of the protrusion 41*a*. According to the arrangement, an area that encloses the opening 51*b* is defined, in plan view, in other words, as seen from the direction orthogonal to the ejection surface 10*a*, by an end of the ejection surface 10*a* that constitutes the other of the longitudinally opposite end portions of the head 10, the pair of regulating plates 60, and the tip 41*a*1 of the protrusion 41*a*. The lower end of each regulating plate 60 is located at the same height level as the ejection surface 10*a*.

Figure 7:
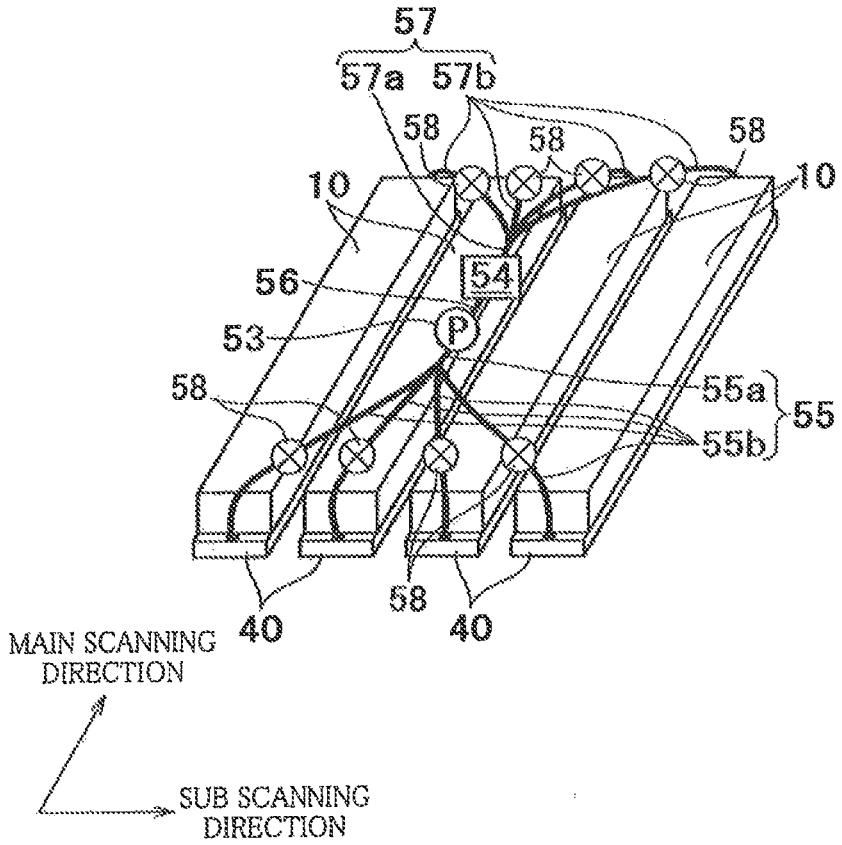
FIG. 7 is a schematic view showing a connection state of all of the heads and the humidifying mechanism included in the printer of FIG. 1.

Referring next to FIGS. 5 and 7, the humidifying mechanism 50 will be explained.

As shown in FIG. 5, the humidifying mechanism 50 includes the joints 51, tubes 55, 56, 57, a pump 53, and a tank 54. One pair of joints 51, namely, two joints 51, are provided for one head 10 while one pump 53 and one tank 54 are provided in the printer 1 so as to be common to the four heads 10, as shown in FIG. 7. The tube 55 has a main portion 55*a* common to the four heads 10 and four branched portions 55*b* which are branched from the main portion 55*a* and which extend to the first joints 51 of the respective four heads 10 while the tube 57 has a main portion 57*a* common to the four heads 10 and four branched portions 57*b* which are branched from the main portion 57*a* and which extend to the second joints 51 of the respective four heads 10.

One end of the tube 55, in other words, each of ends of the respective branched portions 55*b* of the tube 55, is fitted to the extending portion 51*y* of the first joint 51 (the left-side joint 51 in FIG. 5) of the corresponding head 10 while another end of the tube 55, in other words, an end of the main portion 55*a* remote from the branched portions 55*b*, is connected to the pump 53. That is, the tube 55 connects the hollow spaces 51*z* of the first joints 51 of the respective heads 10 and the pump 53 for allowing fluid communication therebetween. The tube 56 connects the pump 53 and the tank 54 for allowing fluid communication therebetween. One end of the tube 57, in other words, each of ends of the respective branched portions 57*b* of the tube 57, is fitted to the extending portion 51*y* of the second joint 51 (the right-side joint 51 in FIG. 5) of the corresponding head 10 while another end of the tube 57, in other words, an end of the main portion 57*a* remote from the branched portions 57*b*, is connected to the tank 54. That is, the tube 57 connects the hollow spaces 51*z* of the second joints 51 of the respective heads 10 and the tank 54 for allowing fluid communication therebetween.

The tank 54 stores, at its lower space, water and, at its upper space, an air humidified by the water stored in the lower space. The tube 56 is connected to the tank 54 at a height level lower than the water surface of the tank 54 and is in communication with the lower space of the tank 54 The tube 57 is connected to the tank 54 at a height level higher than the water surface of the tank 54 and is in communication with the upper space of the tank 54. A check valve (not shown) is provided on the tube 56 so as to prevent the water in the tank 54 from flowing into the pump 53, thereby allowing an air to flow only in a direction indicated by arrows in FIG. 5.

Referring next to FIGS. 5-7, there will be explained operations of various parts of the printer 1 during the humidification maintenance. The humidification maintenance is carried out after the ink ejecting operation has not been carried out for a predetermined time, for instance.

During a series of procedure in the humidification maintenance, the heads 10, the head holder 3, and the conveyor belt 8 are kept fixed at respective locations. The head holder 3 is fixed so as to hold each head. 10 such that a predetermined clearance suitable for the recording operation is formed between the ejection surface 10*a* and the sheet support surface 8*a* of the conveyor belt 8. It is noted that the following explanation will be made with respect to the humidification maintenance performed on one head 10.

In the humidification maintenance, the controller 1*p* initially controls such that the movable body 42 of the enclosing member 40 is moved downward by the rotation of the gears 43. The protrusion 41*a* of the enclosing member 40 is kept located at the retracted position shown in FIG. 6 except when the humidification maintenance is carried out. For instance, the protrusion 41*a* is kept located at the retracted position during the recording operation. The downward movement of the movable body 42 causes the protrusion 41*a* to be moved to the contact position shown in FIG. 5, so that the ejection space 1 isolated from the external space S2 is formed.

Subsequently, the controller 1*p* drives the pump 53, whereby the air in the ejection space S1 is collected from the opening 51*a* of the first joint 51 (the left-side joint 51 in FIG. 5). The air collected from the opening 51*a* reaches the pump 53 through the hollow space 51*z* of the first joint 51 and the space of the tube 55, and reaches the tank 54 through the space of the tube 56. The air is supplied to the lower space of the tank 54, namely, to the underwater. The air is humidified by the water in the tank 54 and is discharged from the upper space of the tank 54. The humidified air passes through the space of the tube 57 and is supplied into the ejection surface S1 from the opening 51*b* of the second joint 51 (the right-side joint 51 in FIG. 5). In FIG. 5, solid arrows indicate a flow of the air before humidified while hollow arrows indicate a flow of the air after humidified. Thus, the humidified air is supplied into the ejection space S1, thereby preventing thickening of the ink in the vicinity of the ejection openings 14*a* and clogging of the ejection openings 14*a*. Further, even if the ink in the vicinity of the ejection openings 14*a* is thickened, the water component owing to the humidified air is supplied to the thickened ink, whereby the ink thickening is eliminated and the condition of the ink recovers.

The controller 1*p* is configured to control, together with the driving of the pump 53, switching valves 58 (FIG. 7) as an adjustor provided on the respective branched portions 55*b*, 57*b*, to thereby selectively adjust respective air flows in the branched portions 55*b*, 57*b*. Accordingly, the humidification maintenance may be performed on only desired one or ones of the heads 10. Alternatively, the humidification maintenance may be performed on all of the heads 10 at one time.

After the pump 53 has been driven for a predetermined time, the controller 1*p* controls the pump 53 to stop driving. Thus, the humidification maintenance is completed. Thereafter, the controller 1*p* controls such that the movable body 42 of the enclosing member 40 is moved upward by the rotation of the gears 43, whereby the protrusion 41*a* is moved from the contact position shown in FIG. 5 to the retracted position shown in. FIG. 6, and the printer 1 is placed in a state in which the recording operation can be restarted.

In the present embodiment, each enclosing member 4 and the conveyor belt 8 constitute a capping mechanism configured to cap the ejection space S1. The first and second joints 51 and the tubes 55, 56, 57 constitute a circulation passage of the humidfying mechanism 50. The pump 53 and the tank 54 constitute a humidifier. The main portion 65*a* of the tube 55, the tube 56, and the main portion 57*a* of the tube 57 constitute a main passage portion of the circulation passage. The branched portions 55*b* of the tube 55 constitute respective branched air-collect passage portions of the circulation passage while the branched portions 57*b* of the tube 57 constitute respective branched air-supply passage portions of the circulation passage.

According to the printer 1 of the present embodiment, the capping mechanism is realized by providing each enclosing member 40 on the head holder 3, thereby eliminating the conventionally required, positioning of the head and the conventional cap relative to each other before initiation of the humidification maintenance and accordingly shortening a time required before the initiation of the humidification maintenance. Further, the present printer 1 in which the openings 51*a*, 51*b* of the respective ends of the circulation passage of the humidifying mechanism 50 are formed in the head holder 3 does not need a large-sized cap in which the humidifying mechanism 50 is disposed, resulting in a size reduction of the printer 1. Moreover, owing to the humidification mechanism 50 constructed as described above, the air in the ejection space S1 is collected from the opening 51*a* of the first end (the first joint 51) of the circulation passage and the air humidified by the water in the tank 54 is supplied into the ejection space S1 from the opening 51*b* of the second end (the second joint 51) of the circulation passage, so that the air in the ejection space S1 can be promptly replaced with the humidified air.

In the present printer 1, the ejection space S1 is isolated from the external space S2 by abutting contact of the tip 41*a*1 of the protrusion 41*a* with the sheet support surface 8*a* of the conveyor belt 8, whereby the ejection surface 10*a* is capped. Accordingly, there is no need to move each head 10 between a recording position at which the ejection surface 10*a* is opposed to the sheet support surface 8*a* and a cap standby space which is distant from each head 10 and in which the above-described conventional cap is kept located during standby. Therefore, the humidification maintenance can be promptly initiated and the recording operation after the humidification maintenance can be promptly restarted. That is, it is possible to shorten a time relating to the humidification maintenance, namely, a time before and after the humidification maintenance. Further, it is not required to ensure the standby space as required by the above-described conventional cap and a route through which the head 10 is moved for the humidification maintenance between the recording position and the standby space. Therefore, the printer 1 can be downsized with higher reliability. In addition, since the openings 51*a*, 51*b* of the respective joints 51 are formed in the head holder 3, there is no need to form any opening in the conveyor belt 8 or the platen 9, obviating a trouble that would hinder supporting and conveyance of the sheet P in the recording operation.

The air in the ejection space S1 is circulated through the tubes 55-57, etc., so as to allow humidification of the air while reducing a water consumption amount.

Where the openings of the first and second ends of the circulation passage are formed in the conveyor belt 8 or the platen 9, there may arise a risk that the openings are closed by the ink ejected onto the conveyor belt 8 or the platen 9 in flushing or purging. The printer 1 according to the present embodiment does not suffer from such a problem.

As shown in FIG. 2, the openings 51*a*, 51*b* of the respective joints 51 are disposed such that the ejection surface 10*a* is located therebetween in plan view, in other words, as seen from the direction orthogonal to the ejection surface 10*a*. Accordingly, the humidified air can be promptly supplied around the ejection openings 14*a*, resulting in efficient humidification with respect to the entirety of the ejection openings 14*a*.

As shown in FIG. 2, the openings 51*a*, 51*b* of the respective joints 51 are disposed such that the ejection surface 10*a* is located therebetween in the longitudinal direction of the ejection surface 10*a*, i.e., in the main scanning direction, in plan view, in other words, as seen from the direction orthogonal to the ejection surface 10*a*. Accordingly, the humidified air can be promptly supplied around the ejection openings 14*a*, and effective humidification is realized with respect to the entirety of the ejection openings 14*a* even where the ejection surface 10*a* is long in one direction (the main scanning direction).

As shown in FIG. 2, the above-indicated separation distance D2 by which the ejection surface 10*a* and the tip 41*a*1 of the protrusion 41*a* are spaced apart from each other in the sub scanning direction is smaller than the above-indicated separation distance D1 by which the ejection surface 10*a* and the tip 41*a*1 of the protrusion 41*a* are spaced apart from each other in the main scanning direction across the opening 51*b*. According to the arrangement, the humidified air supplied from the opening 51*b* is not likely to flow toward widthwise opposite sides of the ejection surface 10*a*, namely, regions S1*a* and S1*b* in the ejection space S1 indicated in FIG. 2, in plan view, but tends to flow in a region of the ejection space S1 facing the ejection surface 10*a*. Therefore, more effective humidification is realized with respect to the entirety of the ejection openings 14*a*.

Further, in the present embodiment, the separation distance D2 by which the ejection surface 10*a* and the tip 41*a*1 of the protrusion 41*a* are spaced apart from each other in the sub scanning direction gradually decreases froth the opening 51*b* toward the opening 51*a* along the main scanning direction. Thus, the separation distance D2 is gradually decreased along the flow of the humidified air in the ejection space S1, whereby the humidified air can be effectively supplied to the ejection openings 14*a* located on the downstream side of the flow, namely, the ejection openings 14*a* located at the lower portion of the ejection surface 10 as seen in FIG. 2.

FIG. 2 shows the positional relationship between the tip 41*a*1 of the protrusion 41*a* and the flow-passage unit 12 of the head 10. The effects owing to the above-described separation distances are the most remarkable in a case in which the conditions of the separation distances are satisfied with respect to an average value of separation distances between the protrusion 41*a* and the ejection surface 10*a* in the vertical direction. This is because the flow of the humidified air in the ejection space S1 is three dimensional including the vertical direction and depends on a cross-sectional area in the vertical direction of a space in which the humidified air flows.

The flow of the humidified air supplied into the ejection space S1 from the opening 51*b* is regulated by the regulating plates 60. That is the humidified air supplied from the opening 51*b* is restrained from flowing toward the widthwise opposite sides of the ejection surface 10*a*, namely, the regions S1*a* and S1*b* in the ejection space S1 in FIG. 2, in plan view, but tends to flow in the region of the ejection space S1 facing the ejection surface 10*a*. Therefore, more effective humidification is realized with respect to the entirety of the ejection openings 14*a*.

Where the head holder 3 is considered as including the enclosing member 40 and the joints 51, a recess 3*x* is formed in the head holder 3 as shown in FIG. 6 and the openings 51*a*, 51*b* of the joints 51 are located at the bottom of the recess 3*x*. The recess 3 is formed between the ejection surface 10*a* and the tip 41*a*1 of the protrusion 41*a* so as to surround the ejection surface 10*a*, in plan view. The bottom of the recess 3*x* at which the openings 51*a*, 51*b* are formed is located at a height level higher than the ejection surface 10*a*. Accordingly, the foreign substances such as ink held on the top of a wiper during wiping are prevented from adhering to the openings 51*a*, 51*b*. Hence, it is possible to avoid operation failures in the humidification maintenance which would be otherwise caused by adhesion of the foreign substances to the openings 51*a*, 51*b*.

The openings 51*a*, 51*b* of the first and second joints 51 which constitute respectively the first and second ends of the circulation passage are formed in the head holder 3. Accordingly, the adhesion of the foreign substances to the openings 51*a*, 51*b* during wiping can be more easily restrained, as compared with an arrangement in which the openings 51*a*, 51*b* are formed in the head 10.

In the present printer 1 constructed as described above, the protrusion 41*a* moves up and down, together with the movable body 42. Accordingly, the capping can be conducted, in other words, the ejection space S1 can be isolated from the external space S2, by moving only the protrusion 41*a* up and down with the head 10 and the conveyor belt 8 kept fixed. Where the head 10 and/or the conveyor belt 8 is/are moved, a relatively large moving mechanism and a relatively long time for the movement are required. In the present embodiment, however, the protrusion 41*a* can be moved by a relatively simple moving mechanism and a time required for the movement of the protrusion 41*a* is shortened. Therefore, the humidification maintenance can be more promptly initiated and the recording operation after the humidification maintenance can be more promptly restarted.

As shown in FIG. 2, the protrusion 41*a* is formed to surround the entire periphery of the ejection surface 10*a* in plan view and is separated away from the ejection surface 10*a* over the entire periphery thereof. Accordingly, it is possible to prevent the wiper from coming into contact with the protrusion 41*a* during wiping.

Where four pumps 53 and four tanks 54 are used, namely, where the pump 53 and the tank 54 are provided for each of the four heads 10 and the tubes 55, 57 are provided for each of the four heads 10, the humidifying mechanism 50 inevitably becomes large-sized. In contrast, in the present embodiment, one pump 53 and one tank 54 are provided so as to be common to the four heads 10 and the tubes. 55, 57 include the respective main portions 55*a*, 57*a* and the respective four branched portions 55*b*, 57*b*, as shown in FIG. 7. Accordingly, the humidifying mechanism 50 can be downsized even where the printer 1 includes a plurality of heads 10.

The controller 1*p* is configured to control the switching valves 58 provided on the respective branched portions 55*b*, 57*b* shown in FIG. 7 so as to selectively adjust the respective air flows in the branched portions 55*b*, 57*b*, thereby making it possible to allow the air flows in only a part of the branched portions 55*b*, 57*b*. In other words, the humidified air can be supplied only to the ejection space(s) S1 of desired one or ones of the heads 10, permitting appropriate humidification maintenance depending upon various situations.

The controller 1*p* is configured to control driving of the pump 53 such that the humidified air whose volume is not smaller than the volume of the ejection space S1 is supplied form the opening 51*b* into the ejection space S1. Accordingly, the air in the ejection space S1 is entirely replaced with the humidified air, so that the humidified air can be appropriately supplied into the ejection space S1.

The upper space of the tank 54, i.e., the space above the water surface, has a volume not smaller than as total of the volumes of the ejection spaces S1 of the respective four heads 10. Accordingly, the air in the ejection spaces S1 of all of the four heads 10 can be speedily replaced. In other words, the humidified air can be speedily and efficiently supplied into the ejection surfaces S1 of all of the four heads 10.

The sheet support surface 8*a* of the conveyor belt 8 with which the tip dial of the protrusion 41*a* is to come into contact is entirely fiat, ensuring reliable capping. Other structure is similar to that in the illustrated first embodiment.

Figure 8:
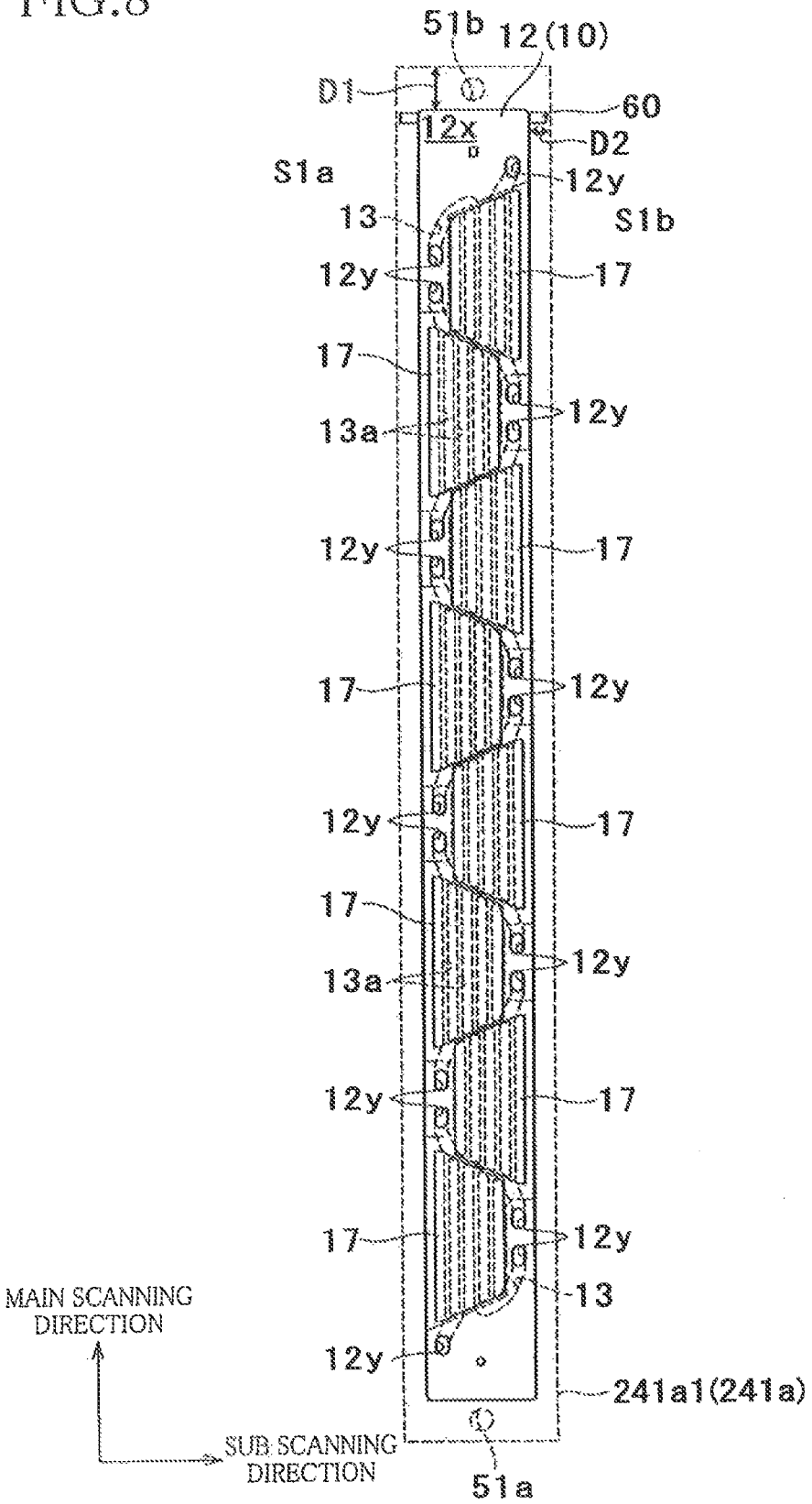
FIG. 8 is a plan view similar to that of FIG. 2 and shows an ink-jet printer according to a second embodiment of the invention.

Referring next to FIG. 8, there will be explained an inkjet printer according to a second embodiment of the invention. The printer in this second embodiment differs from the printer in the illustrated first embodiment only in the shape, in plan view, formed by the protrusion of the enclosing member.

A protrusion 241*a* of the enclosing member in the second embodiment extends so as to form a rectangular shape, in plan view, similar to the contour of the ejection surface 10*a*, i.e., the lower surface of the head 10 shown in FIG. 8. In other words, the contour of the protrusion 241*a* in plan view is a rectangular shape. A separation distance, in plan view, namely, a separation distance as seen from the direction orthogonal to the ejection surface 10*a*, by which the ejection surface 10*a* and a tip 241*a*1 of the protrusion 241*a* are spaced apart from each other is determined in a similar manner to that in the illustrated first embodiment. More specifically, a separation distance D2 by which the ejection surface 10*a* and the tip 241*a*1 of the protrusion 241*a* are spaced apart from each other in the sub scanning direction is smaller than a separation distance D1 by which the ejection surface 10*a* and the tip 241*a*1 are spaced apart from each other in the main scanning direction across the opening 51*b*. The separation distance D1 in the main scanning direction is the same at opposite ends of the ejection surface 10*a* in the main scanning direction and is constant along the sub scanning direction. The separation distance D2 in the sub scanning direction is the same at opposite ends of the ejection surface 10*a* in the sub scanning direction and is constant along the main scanning direction.

The present embodiment enjoys the same effects as in the illustrated first embodiment except for the effect offered by the separation distance D2 which is arranged to gradually decrease from the opening 51*b* toward the opening 51*a* along the main scanning direction.

Figure 9:
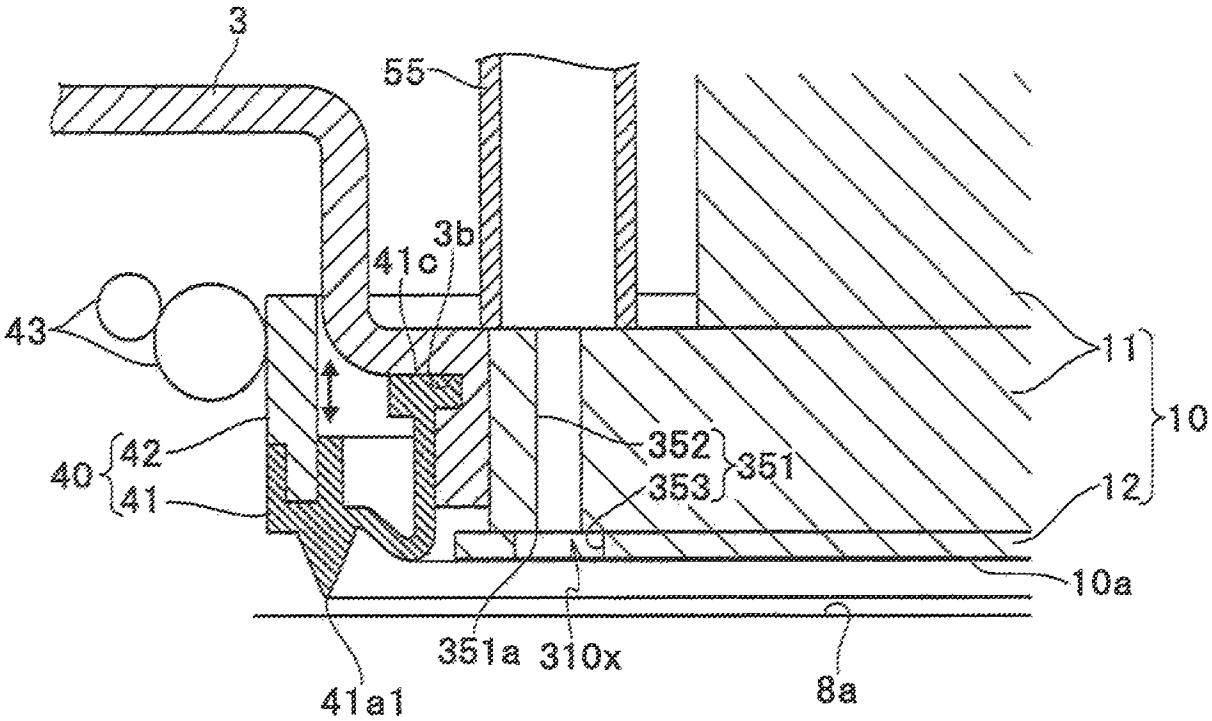
FIG. 9 is a partial cross-sectional view similar to that of FIG. 6 and shows an inkjet printer according to a third embodiment of the invention.

Referring next to FIG. 9, there will be explained an ink-jet printer according to a third embodiment of the invention. The printer in this third embodiment differs from the printer in the illustrated first embodiment only in that the openings of the circulation passage are formed not in the head holder 3, but in the head 10. Other structure is similar to that in the illustrated first embodiment.

In the third embodiment, vertically extending through-holes 351 are formed in the head 10, in place of the joints 51. Two through-holes 351 are formed in one head 10 at respective positions corresponding to those of the joints 51. Each through-hole 351 consists of a cylindrical through-hole 352 formed in the reservoir unit 11 and a cylindrical through-hole 353 formed in the flow-passage unit 12. The through-holes 352, 353 have the same center axis and mutually different diameters. That is, the diameter of the through-hole 353 is larger than that of the through-hole 352.

A recess 310*x* partially provides the through-holes 353 is formed in the surface of the head 10, i.e., the ejection surface 10*a*, and two openings of the circulation passage are formed in the bottom of the recess 310*x*. While only one (351*a*) or the two openings is shown in FIG. 9, the other of the openings is similarly formed. In this arrangement, the bottom of the recess 310*x* in which the openings (351*a*) are formed is located at a height level higher than the ejection surface 10*a*, thereby preventing the foreign substances such as ink held on the top of a wiper during wiping from adhering to the openings (351*a*). Hence, it is possible to avoid operation failures in the humidification maintenance which would be otherwise caused by adhesion of the foreign substances to the openings (351*a*).

As in the illustrated first embodiment, the humidification maintenance can be promptly initiated and the recording operation after the humidification maintenance can be promptly restarted without causing a trouble to supporting and conveyance of the sheet P during the recording operation while ensuring downsizing of the printer. More specifically, since the enclosing member 40 is provided on the head holder 3 so as to realize the capping mechanism, there is no need to move the head 10 to the above-described cap standby position which is distant from the head 10 and in which the above-described conventional cap is kept located during standby. Therefore, the humidification maintenance can be promptly initiated and the recording operation after the humidification maintenance can be promptly restarted. Further, it is not required to ensure the standby space as required by the above-described conventional cap and a route through which the head 10 is moved for the humidification maintenance between the recording position and the standby space. Therefore, the printer 1 can be downsized. In addition, since the openings of the circulation passage are formed in the head 10, there is no need to form any opening in the conveyor belt 8 or the platen 9, obviating a trouble that would hinder supporting and conveyance of the sheet P during the recording operation.

According to the third embodiment, the openings of the circulation passage are formed in the head 10. In particular, the other of the openings from which the humidified air is supplied is formed in the head 10, whereby the opening can be disposed nearer to the ejection openings 14*a*, resulting in effective supply of the humidified air to the ejection openings 14*a*.

In the third embodiment, the openings of the circulation passage are disposed such that a group of the ejection openings 14*a* consisting of all ejection openings 14*a* formed in the ejection surface 10*a* are located between the two openings in plan view, namely, the openings are respectively disposed on outer sides of the two outermost actuator units 17 which are located at opposite ends in the main scanning direction shown in FIG. 2. Accordingly, the entirety of the ejection openings 14*a* can be effectively humidified.

In the third embodiment, a separation distance, in plan view, namely, a separation distance as seen from the direction orthogonal to the ejection surface 10*a*, by which the group of the ejection openings (corresponding to the eight actuator units 17) and the tip 41*a*1 of the protrusion 41*a* are spaced apart from each other in the sub scanning direction is smaller than a separation distance, in plan view, by which the group of the ejection openings and the tip 41*a*1 of the protrusion 41*a* are spaced apart from each other in the main scanning direction across the other opening. According to the arrangement, the humidified air supplied from the other opening is not likely to low toward widthwise opposite sides of a region of the group of the ejection openings in the ejection space S1, in plan view, but tends to flow in a region of the ejection space S1 facing the group of the ejection openings, namely, in a region of the ejection space S1 corresponding to the actuator units 17. Therefore, more effective humidification is realized with respect to the entirety of the ejection openings 14*a*.

Further, in the third embodiment, the above-indicated separation distance by which the group of the ejection openings (corresponding to the eight actuator units 17) and the tip 41*a*1 of the protrusion 41*a* are spaced apart from each other in the sub scanning direction gradually decreases from the other of the openings to the one 351*a* of the openings along the main scanning direction. Thus, the separation distance is gradually decreased along the flow of the humidified air in the ejection space S1, whereby the humidified air can be effectively supplied to the ejection openings 14*a* located on the downstream side of the flow, namely, the ejection openings 14*a* located at the lower portion of the ejection surface 10 as seen in FIG. 2.

The third embodiment offers effects similar to those in the illustrated first embodiment by the structure similar to that in the illustrated first embodiment.

The elastic body 41 of the enclosing member 40 in the third embodiment is held by the head holder 3 such that the fixed portion 41*c* is fitted in a fitting recess 3*b* of the head holder 3, as shown in FIG. 9. Further, one end of each of the tubes 55, 57 is fixed to the surface of the reservoir unit 11 in which the upper open end of the corresponding through-hole 352 is formed, so as to cover the through-hole 352.

Figure 10:
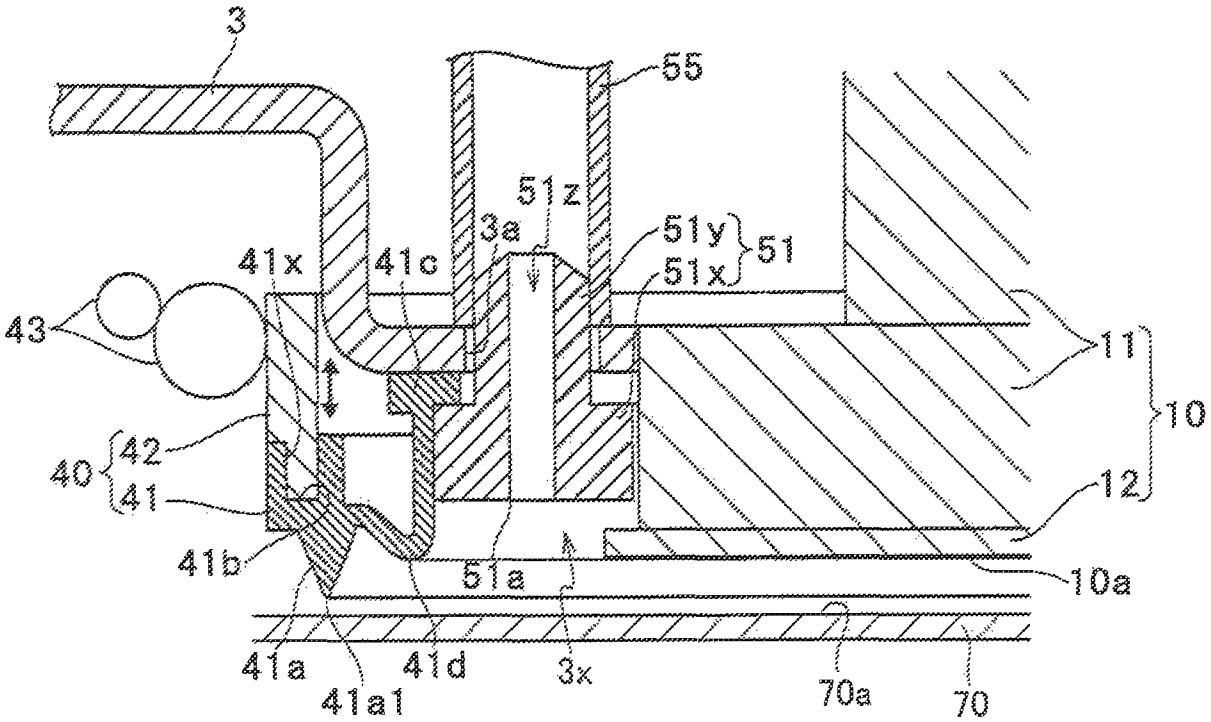
FIG. 10 is a partial cross-sectional view similar to that of FIG. 6 and shows an inkjet printer according to a fourth embodiment of the invention.

Referring next to FIG. 10, there will be explained an inkjet printer according to a fourth embodiment of the invention. The printer in this fourth embodiment differs from the printer in the illustrated first embodiment only in that the surface with which the tip 41*a*1 of the protrusion 41*a* comes into contact is not the sheet support surface 8*a* of the conveyor belt 8. Other structure is similar to that in the illustrated first embodiment.

In the printer of the fourth embodiment, a plate member 70 formed of metal, plastic, or the like is used as the facing member to face the ejection surface 10*a* of each head 10. The ejection space S1 is isolated from the external space S2 by abutting contact of the protrusion 41*a* with an upper surface 70*a*, as the facing surface, of the plate member 70, whereby the ejection surface 10*a* is capped. For permitting the upper surface 70*a* of the plate member 70 to face the ejection surface 10*a*, in a state in which the head 10 and the conveyor unit 21 are kept fixed, the plate member 70 disposed at a position at which the plate member 70 does not overlap, in plan view, the head 10 and the conveyor unit 21 may be horizontally moved so as to be inserted between the ejection surface 10*a* and the sheet support surface 8*a*. Instead, in a state in which the plate member 70 is kept fixed at a position at which the plate member 70 does not overlap, in plan view, the head 10 and the conveyor unit 21 and in which the conveyor unit 21 is kept fixed, the head 10 may be horizontally moved such that the ejection surface 10*a* faces the upper surface 70*a* of the plate member 70. Further, in a state in which the plate member 70 is kept fixed below the conveyor belt 8 and in which the head 10 is kept fixed, the conveyor unit 21 may be horizontally moved such that the upper surface 70*a* of the plate member 70 faces the ejection surface 10*a* of the head 10.

As in the illustrated embodiments, the capping mechanism is realized in this fourth embodiment by providing each enclosing member 40 on the head holder 3, thereby eliminating the conventionally required positioning of the head 10 and the above-described conventional cap relative to each other before initiation of the humidification maintenance and accordingly shortening a time required before the initiation of the humidification maintenance. Further, the openings 51*a*, 51*b* of the respective ends of the circulation passage of the humidifying mechanism 50 are formed in the head holder 3, so that a large-sized cap in which the humidifying mechanism 50 is disposed is not needed, resulting in a size reduction of the printer 1. Moreover, owing to the humidification mechanism 50 constructed as described above, the sir in the ejection space S1 is collected from the opening 51*a* of the first end of the circulation passage and the air humidified by the water in the tank 54 is supplied into the ejection space S1 from the opening 51*b* of the second end of the circulation passage, so that the air in the ejection space S1 can be promptly replaced with the humidified air.

While the presently preferred embodiments of the invention have been explained, it is noted that the invention is not limited to the details of the illustrated embodiments, but may be embodied with various changes and modifications, which may occur to those skilled in the art, without departing from the spirit and scope of the invention defined in the attached claims.

The material, the shape, the position, etc., of the regulator are not particularly limited. For instance, the regulator may be formed to extend in any arbitrary direction other than the sub scanning direction. The regulator may be fixed to the head holder 3 or the enclosing member 40, in place of the head 10. The regulator is not limited to the illustrated plate-like shape, but may have any shape.

The regulator may be eliminated.

As the moving mechanism for moving the protrusion, the gears 43 are utilized in the illustrated embodiments. Any other means such as a solenoid and a cam mechanism using a link may be utilized.

In the illustrated embodiments, when the protrusion 41*a* is located at the retracted position, the tip 41*a*1 of the protrusion 41*a* is located between the ejection surface 10*a* and the sheet support surface 8*a* as shown in FIG. 6, namely, the tip 41*a*1 is located nearer to the sheet support surface 8*a*, as compared with the ejection surface 10*a*. The tip 41*a*1 may be otherwise located when the protrusion 41*a* is located at the retracted position. For instance, for preventing paper jamming, it is preferable that the tip 41*a*1 be preferably located at a height level higher than the ejection surface 10*a*, namely, the tip 41*a*1 is preferably more distant from the sheet support surface 8*a*, as compared with the ejection surface 10*a*.

In the illustrated embodiments, the protrusion is arranged to be movable. However, the protrusion may be otherwise arranged. For instance, the protrusion may be immovably fixed to the head holder, and the relative position of the tip of the protrusion with respect to the ejection surface may be made constant. In this instance, the relative position of the tip of the protrusion with respect to the ejection surface may be changed by moving up and down the head holder or the medium support surface of the medium support portion, thereby allowing the protrusion to be selectively placed at one of the contact position and the retracted position.

The material, the shape, etc., of the protrusion are not particularly limited. For instance, the protrusion may be formed of a rigid material, in place of the elastic material. The protrusion may protrude in a direction inclined with respect to the vertical direction. The cross-sectional shape of the protrusion may have a rectangular shape, in place of the inverted triangular shape. That is, the protrusion may not be tapered. The protrusion may not be separated away from the ejection surface over the entire periphery of the ejection surface, in plan view, but may partially contact the ejection surface or may contact the ejection surface over the entire periphery thereof, in plan view. The protrusion may extend so as to form any shape, in plan view, other than the trapezoidal shape and the rectangular shape. In other words, the contour of the protrusion in plan view may not limited to the illustrated trapezoidal shape and rectangular shape. The separation distance, in plan view, by which the ejection surface 10*a* (or the group of the ejection openings in the case where the openings of the circulation passage are formed in the head) and the tip of the protrusion are spaced apart from each other may not be particularly limited. For instance, the above-indicated separation distance D2 in the sub scanning direction may be zero. The manner in which the protrusion is held by the head holder may be variously changed.

The recess 3*x* formed in the head holder and the recess 310*x* formed in the head may not be formed so as to surround the periphery of the ejection surface 10*a* in plan view. For instance, the recess may be formed only at a portion where the opening of either one of the two opposite ends (the first and second ends) of the circulation passage is formed or only at portions where the openings of the respective two opposite ends of the circulation passage are formed.

The shape and the position of the opening of each of the first and second ends of the circulation passage are not particularly limited as long as the opening is formed in the head or the head holder and is open to the ejection surface. For instance, one of the openings may be formed in the head and the other of the openings may be formed in the head holder. Each opening may be formed in the protrusion. In place of forming the recess 3*x*, 310*x* in the head holder or the head, the opening of at least one of the two opposite ends of the circulation passage may be formed at the same height level as the ejection surface 10*a*. The openings may be disposed such that the ejection surface 10*a* (or the group of the ejection openings in the case where the openings are formed in the head) is located between the openings in the sub scanning direction in plan view. Alternatively, the openings may be disposed such that the ejection surface 10*a* (or the group of the ejection openings in the case where the openings are formed in the head) is not located between the openings in plan view. For instance, the openings may be disposed on the same one of opposite sides of the ejection surface 10*a* or the group of the ejection openings.

The pump 53 and the tank 64 may be provided for each of the four heads 10, and the tube 55 and the tube 57 may be provided for each of the four heads 10.

In the illustrated embodiments, the pump 53 and the tank 54 function as the humidifier. Various other means may be employed as the humidifier as long as the humidifier is configured to humidify the air in the circulation passage. For instance, the pump 53 may be eliminated, and only the tank 54 may be utilized for humidification. A heating means such as a heater may be additionally used. An ultrasonic humidifier may be used. A porous member such as a sponge impregnated with water, a cloth or the like may be disposed in the circulation passage for humidification.

The positions of the constituent elements of the humidifying mechanism are not particularly limited. For instance, some (the joints 51, etc.,) of those may be provided on the head or the head holder and the rest the tubes 55-57, the pump 53, the tank 54, etc.,) may be provided at arbitrary positions in the printer.

The medium support portion is not limited to the illustrated conveyor unit including the conveyor belt, but may be a platen roller, a drum or the like, as long as the medium support portion is configured to support the recording medium. The medium support portion may not be configured to move, like the conveyor belt, for conveying the recording medium. The head be moved for performing the recording operation on the recording medium supported by a stationary medium support portion.

The facing member is not limited to the illustrated conveyor belt and plate member, but any suitable member may be used as long as the facing member has the facing surface that is to face the ejection surface.

The ejection surface or the group of ejection openings may not be long in one direction.

The present invention is applicable to both of a line-type printer and a serial-type printer. Further, the present invention is applicable to a facsimile machine, a copying machine, etc., other than the printer. The present invention is applicable to apparatus configured to eject a liquid other than the ink.

The recording medium is not limited to the illustrated sheet P, but may be any kind of recordable medium.

What is claimed is:

1. A liquid ejecting apparatus, comprising:

a head having an ejection surface in which ejection openings are open through which a liquid is ejected to a recording medium, the ejection openings being formed in a first region in the ejection surface, the first region having a longitudinal direction along a main scanning direction;

a head holder for holding the head;

a capping mechanism, having a cap, configured to cap the ejection surface so as to form an ejection space that is partially defined by the cap and the ejection surface; and a humidifying mechanism which has:

a circulation passage having, at opposite ends thereof, a first end and a second end that are open to the ejection space, the circulation passage being configured such that an air passes through the circulation passage between the first end and the second end; and a humidifier configured to humidify the air in the circulation passage, an opening of the first end and an opening of the second end being provided in one of the head and the head holder, the humidifying mechanism being configured to collect an air in the ejection space from the opening of the first end and to supply the air humidified by the humidifier into the ejection space from the opening of the second end, wherein each of the opening of the first end and the opening of the second end is formed in a first portion of one of the head and the head holder, and the first portion of one of the head and the head holder is disposed between the first region of the ejection surface and the cap in the main scanning direction.

2. The liquid ejecting apparatus according to claim 1, wherein all of the ejection openings are formed in the ejection surface as a group, and wherein the opening of the first end and the opening of the second end of the circulation passage are disposed such that the group of the ejection openings formed in the ejection surface is located therebetween.

3. The liquid ejecting apparatus according to claim 2, wherein the group of the ejection openings is provided in the ejection surface within the first region, and wherein the opening of the first end and the opening of the second end of the circulation passage are disposed such that the group of the ejection openings is located therebetween in the main scanning direction.

4. The liquid ejecting apparatus according to claim 1, wherein at least one of the opening of the first end and the opening of the second end of the circulation passage is formed in the head holder.

5. The liquid ejecting apparatus according to claim 1, wherein the opening of the second end of the circulation passage is formed in the head.

6. The liquid ejecting apparatus according to claim 1, comprising a plurality of heads each as the head, wherein the circulation passage includes: a main passage portion common to the plurality of heads; and a plurality of branched air-collect passage portions and a plurality of branched air-supply passage portions which correspond to the respective heads, the plurality of branched air-collect passage portions being branched from the main passage portion so that an end of each of the branched air-collect passage portions serves as the first end while the plurality of branched air-supply passage portions are branched from the main passage portion so that an end of the branched air-supply passage portions serves as the second end.

7. The liquid ejecting apparatus according to claim 6, further comprising an adjustor configured to selectively adjust respective air flows in the branched air-collect passage portions and the branched air-supply passage portions.

8. The liquid ejecting apparatus according to claim 1, further comprising a recess formed in one of the head and the head holder, wherein at least one of the opening of the first end and the opening of the second end of the circulation passage is formed in a bottom of the recess.

* * * * *